United States Patent [19]

Arnold et al.

[11] Patent Number: 4,900,432

[45] Date of Patent: Feb. 13, 1990

[54] POOL SURFACE CLEANER

[76] Inventors: Aaron L. Arnold, 15393 70th Trail N, Palm Beach Gardens, Fla. 33418; Daniel A. Woodward, 807 Briarwood Dr., West Palm Beach, Fla. 33415

[21] Appl. No.: 301,015

[22] Filed: Jan. 24, 1989

[51] Int. Cl.[4] ..... E04H 3/20

[52] U.S. Cl. ..... 210/91; 210/169; 210/242.1; 4/490; 15/1.7

[58] Field of Search ..... 210/91, 169, 242.1; 4/490, 492; 15/1.7; 134/167 R; 417/411

[56] References Cited

U.S. PATENT DOCUMENTS

| | | | |
|---|---|---|---|
| 3,753,265 | 8/1973 | Wulc | 15/1.7 |
| 3,860,518 | 1/1975 | Henricksen | 4/490 |
| 3,928,202 | 12/1975 | Raubenheimer | 15/1.7 |
| 4,105,557 | 8/1978 | Weatherbolt | 210/242.1 |
| 4,429,429 | 2/1984 | Altschul | 134/167 R |
| 4,461,704 | 7/1984 | Selsted | 4/490 |
| 4,746,424 | 5/1988 | Drew | 134/167 R |
| 4,802,829 | 2/1989 | Miller | 417/411 |

FOREIGN PATENT DOCUMENTS

| | | | |
|---|---|---|---|
| 2156700 | 10/1985 | United Kingdom | 4/490 |
| 2203333 | 10/1988 | United Kingdom | 4/492 |

*Primary Examiner*—W. Gary Jones
*Assistant Examiner*—Coreen Y. Lee

[57] ABSTRACT

A cleaner for removing floating debris from the surface of pools has a floating body with a central chamber within which is positioned a screen. An impeller at the front of the cleaner propels water rearward into the chamber, and propels the cleaner. The water passes through the screen and exits from the chamber. In one example the screen is mounted in a removable support structure, which can be removed through the rear of the body for emptying. The impeller is driven by a motor powered by a solar cell array and batteries.

13 Claims, 4 Drawing Sheets

POOL SURFACE CLEANER

BACKGROUND OF THE INVENTION

1. Field of the Invention

This invention relates to a surface cleaner for pools, and, in particular, to a self-contained propelled cleaner, for cleaning the surfaces of outside swimming pools and similar pools, such as are built at residential and other premises.

2. Related Art

The surfaces of pools built outside, in yards of houses and apartment buildings, motels and hotels for example, suffer from leaves, grass and other debris being blown or otherwise being caused to fall onto the water surface. Insects also fall onto the surface. The surface can be cleaned by skimming with a net and also by causing the pool to overflow along one or more edges, with the water being circulated through a filter. If underwater, self-activated, pool cleaners are used to clean the bottom and sides of the pool, this can interfere with surface cleaning by reducing the overflow of water. Use of a skimming net is tedious and not fully effective. Also, built-in skimmers are not always effective due to unusual flow patterns at the water surface, and interference from wind causing the debris to float to a side.

SUMMARY OF THE INVENTION

The present invention provides a self-contained cleaner which floats on the pool surface and travels across the surface, the surface layer of the pool being skimmed off into a chamber in the cleaner. A screen is positioned in the chamber, the water passing through the screen and exiting from the chamber, any floating debris being retained in the screen. The water is caused to flow over a front wall of the chamber by an impeller. The action of the impeller on the water also acts to propel the cleaner. Conveniently, the impeller is driven by an electric motor, powered for example by a rechargeable battery. A solar cell array can be provided to supply electric power to charge the battery as necessary and also drive the motor directly.

Broadly, the invention provides a pool surface cleaner comprising a floatable main body member having a central chamber, the chamber having a front surface having a top edge at or slightly above the level of the pool surface when the cleaner is in a pool, side and rear walls extending above the pool surface, and a bottom surface below the pool surface, a screen being mounted in the chamber. An impeller is mounted above the front surface for propelling water into the chamber, and a motor is mounted on the main body member for driving the impeller. A solar array provides power for recharging the battery and for driving the motor. To prevent the cleaner from being trapped against a wall of a pool, a further propulsion means acting to turn the cleaner can be provided.

BRIEF DESCRIPTION OF THE DRAWINGS

The invention will be readily understood by the following description, in conjunction with the accompanying drawings, in which.

DETAILED DESCRIPTION OF DRAWINGS

Figure 1:
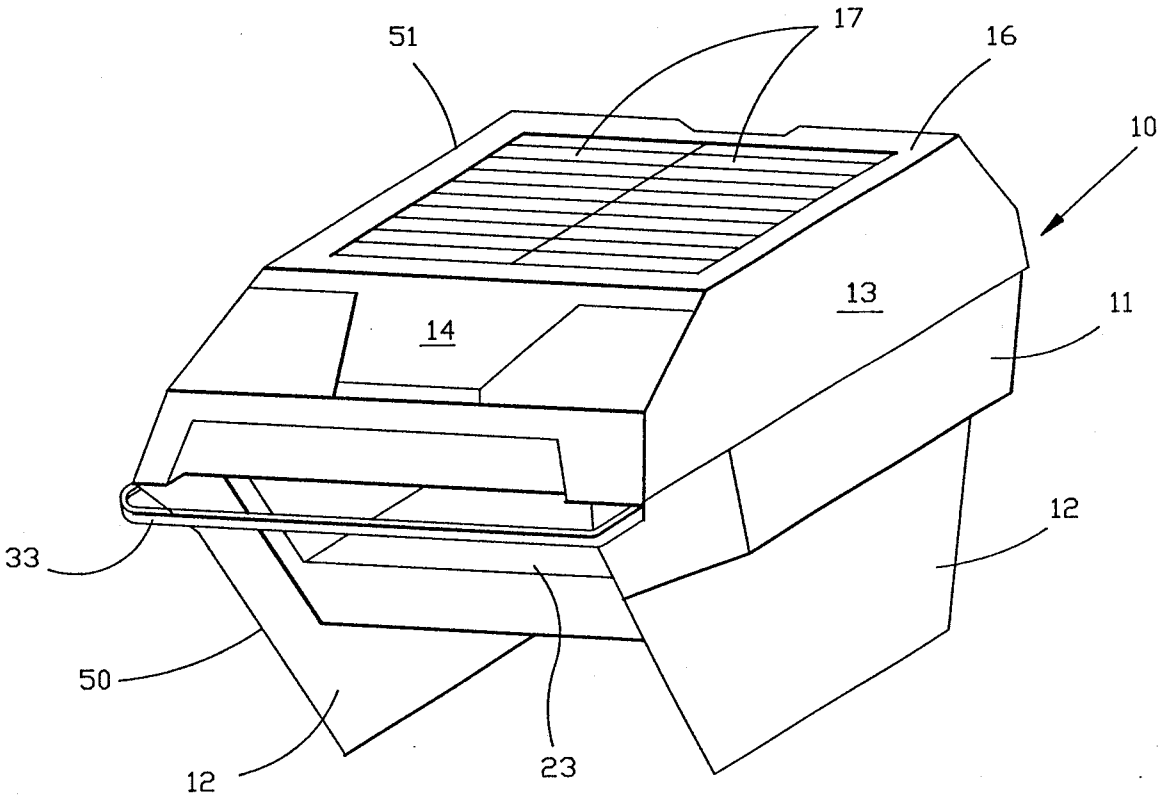
FIG. 1 is a front perspective view of one form of a cleaner.
Figure 2:
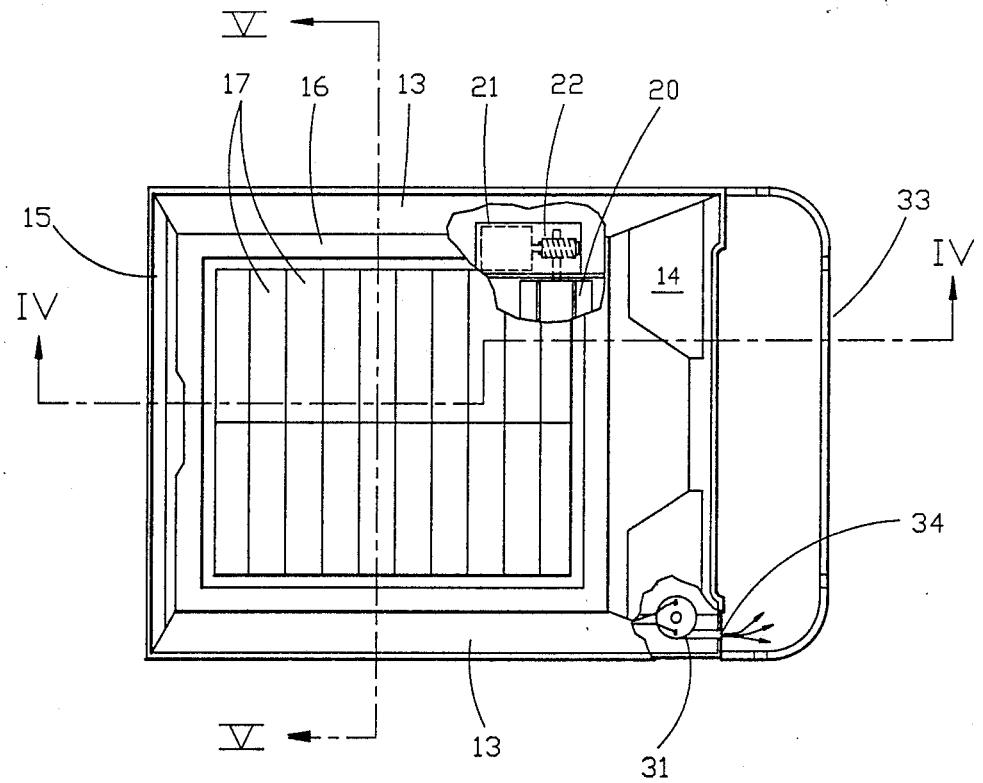
FIG. 2 is a top plan view of the cleaner illustrated in FIG. 1.
Figure 3:
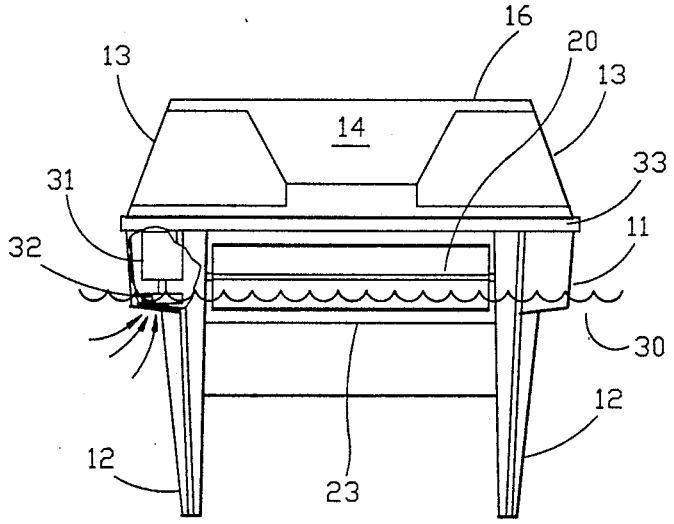
FIG. 3 is a front view of the cleaner illustrated in Figure 1.

FIGS. 1 to 5 illustrate one form of cleaner having a main body member 10, having floatation or buoyancy members 11 extending along each side and combination buoyancy and stabilizing members 12 extending below the floatation members 11. The main body is hollow, forming a central chamber 27, having side walls 13, front wall 14 and rear wall 15. A top surface 16 carries a solar cell array 17. At the underside of the top surface 16 is mounted an electronic control circuit board 18.

Extending between the floatation members 11, at the front end of the cleaner, is an impeller 20, in the example a radial vane impeller. The impeller is driven by an electric motor 21 mounted in one of the floatation members 11, the motor driving the impeller via gearing 22. Across the front of the cleaner, between the floatation members, extends a surface 23. The surface is positioned below the impeller, with a small clearance, and has a barrier or weir 24 at its rear edge, projecting upward. Water is propelled up and over barrier 24, which prevents the water from flowing back out the front.

Behind the surface 23, and the barrier 24, extending between the stabilizing members 12, is a removable support structure 25, which carries a screen 26 through which flows the water propelled over the barrier 24, leaving behind the debris. The water, after flowing through the screen, escapes from the central chamber 27, for example by flowing out of the rear. The screen can be removed through the back wall for cleaning. The support structure 25 can be supported by rails 28 at each side, and slide in and out on the rails.

Figure 4:
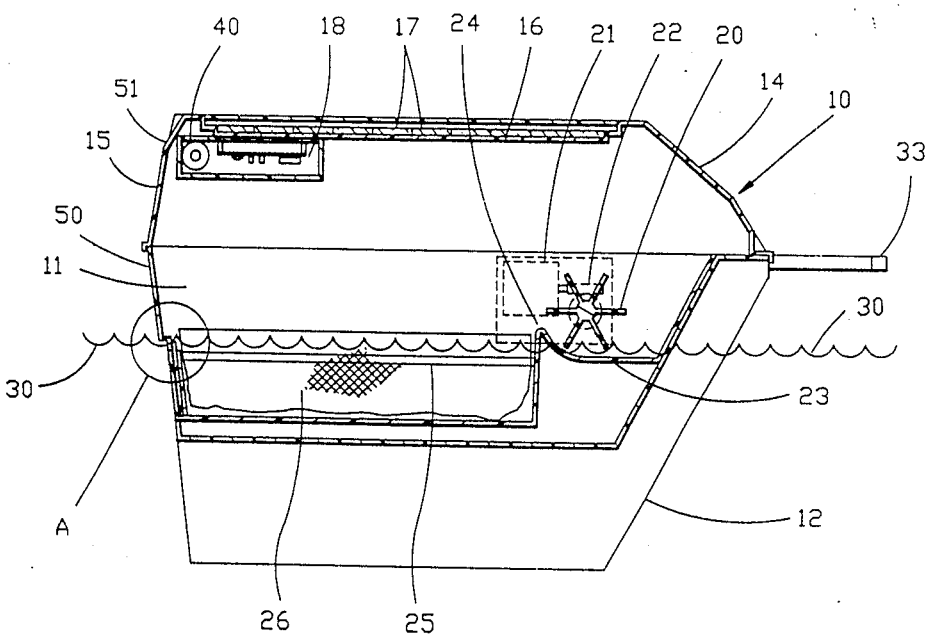
FIG. 4 is a cross -section on the line IV—IV of FIG. 2.
Figure 5:
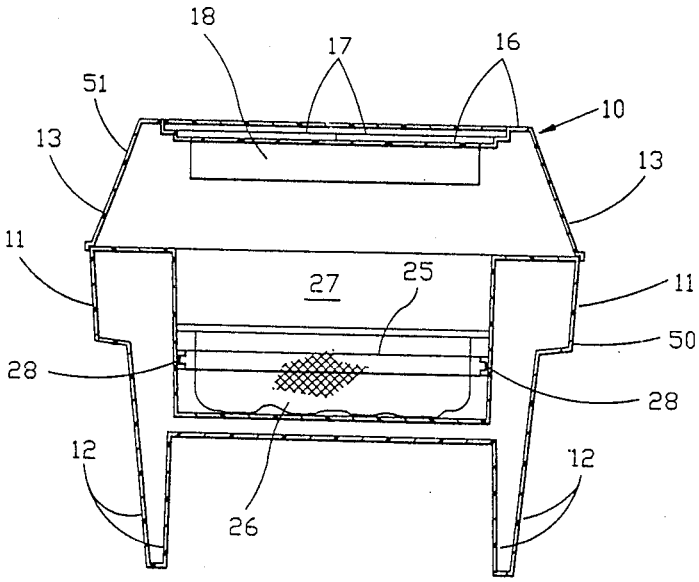
FIG. 5 is cross-section on the line V—V of FIG. 2.

In use, the cleaner floats in the pool, the pool surface being indicated at 30. The impeller rotates and propels water over the barrier 24 into the central chamber 27. It also moves the cleaner forward. As seen in FIG. 4, the surface 23 is below the water surface, as the impeller vanes must extend into the water. The water, as it is propelled over the barrier 24, carries with it any debris floating on the surface. The water escapes through the screen with the debris being retained in the screen. The screen can be periodically removed, for example through the back of the cleaner, for removal of debris.

It is possible that the cleaner could become held against a wall or corner of the pool, becoming immobilized. To avoid this, a further electric motor 31 is mounted in a floatation member, near the front of the cleaner. In the example, the further motor is mounted in the other floatation member, relative to the mounting of motor 21. Motor 31 is mounted with its axis vertical and drives an impeller 32 which impels water out through a hole 34 in the front end of the floatation member, in the example illustrated. The impeller 32 is below the water surface 30, water entering through the bottom of the floatation member and ejected also below the water surface.

A sensor 33 at the front of the cleaner detects the approach of the cleaner to the wall of the pool. When such an approach is detected, motor 31 is switched on and the water ejected by impeller 32 causes the cleaner to turn. After a predetermined time delay, motor 31 is switched off. Conveniently, the sensor comprises two conductors separated at intervals by insulators. Upon contacting a barrier, the conductors deflect and make contact with one another, completing an electrical circuit.

Figure 6:
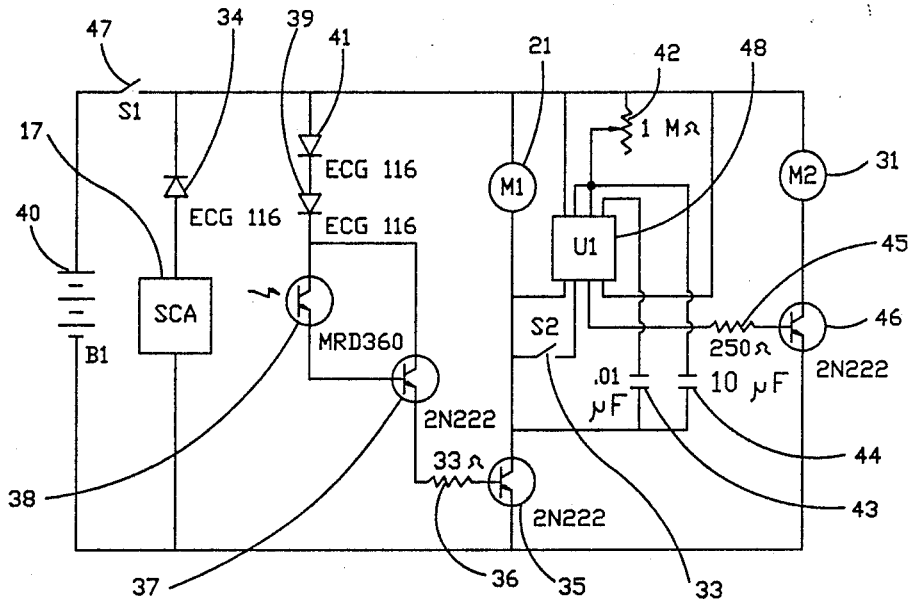
FIG. 6 is a circuit diagram for a control system for the cleaner propulsion.

FIG. 6 is one circuit diagram of a control system for the cleaner propulsion. Items in FIG. 6 which are also in FIGS. 1 to 5, have the same reference numerals As illustrated in FIG. 6, a battery assemblage 40 is connected across the solar cell array 17, the batteries being isolated from discharging through the solar cells by diode 34. The batteries 40 can also be isolated from the circuit with manual switch 47. Also connected across the solar cell array is the motor 21 which is series connected with transistor 35.

In operation, current flows through diodes 39 and 41, supplying voltage to the collectors of transistors 37 and 38. If sufficient light is available at the aperture of photo-transistor 38, it conducts current to the base of transistor 37. If sufficient voltage is supplied at the base of transistor 37, it conducts current to the base of transistor 35 through current limiting resistor 36. When sufficient voltage is supplied to the base of transistor 35, it conducts current from motor 21 to the batteries 40 negative terminal. It simultaneously provides the return path for current from the remainder of the circuit described below.

The purpose of photo-transistor 38 is to limit the cleaner operation to daylight hours. The purpose of diodes 39 and 41 is to prevent the batteries 40 from completely discharging. This is accomplished by reducing the voltage available to the base of transistor 35 by semiconductor voltage drops through diodes 39 and 41 and transistor 37. When battery voltage drops such that the voltage reduced through diodes 39 and 41 and transistor 37 is insufficient to turn transistor 35 on, all operation of the cleaner ceases.

The remainder of the circuit is concerned with the sensing of the pool edge, and operating the turning motor for a time period. Typical component numbers and values are indicated in FIG. 6.

The cleaner turning motor 31 is supplied current from the batteries 40 through switch 47, or from the solar cell array 17 through diode 34. A widely used timer circuit comprised of an integrated circuit 48, adjustment variable resistor 42, and capacitors 43 and 44 is initiated when the pool edge detection switch 33 closes (by contacting the pool edge). Current is immediately supplied to the base of transistor 46 through current limiting resistor 45, turning on transistor 46 and completing the current path for turning motor 31.

Transistor 46, and thus the turning motor, remains on for a time period as determined by the timer circuit adjustment. Specifically, the resistance of variable resistor 42, in combination with capacitors 43 and 44, determines the time period. At the expiration of the time period, the timer circuit ceases to supply current to transistor 46, turning off turning motor 31.

In the example illustrated in FIGS. 1 to 5, the body member is in two major parts, a bottom part 50 comprising the buoyancy members 11 and the stabilizing members 12, and a top part 51 which extends over and attaches to the bottom part, carrying the solar cell array, control system, and batteries. Contacts on the top and bottom parts connect the batteries and control system to the motors and any other item.

It is desirable that the water level 30 have a particular relationship relative to the barrier 24, and the impeller 20. It is necessary that the impeller is immersed to insure satisfactory propulsion of the water and debris over the barrier, and that the barrier is above the water level, but not much above. The floating level of the cleaner is determined by its weight, and its displacement. This can be adjusted by adding or subtracting weights in the floatation chamber for example.

Figure 7:
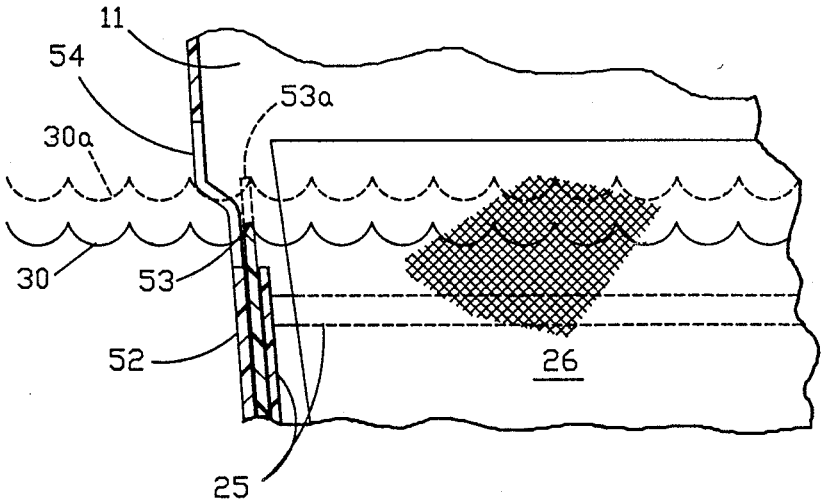
FIG. 7 is a partial cross-section as in FIG. 4 area A, to a larger scale, illustrating a modification.

FIG. 7 illustrates a modification where the water level 30 is adjusted relative to the impeller and barrier by varying the height of a rear wall over which the water escapes from the central chamber 27. In the example a rear will 52 forms part of the support structure 25 and has a slidable member 53 which can be raised and lowered. In FIG. 7 a lower position of the member 53 is shown in full outline with the water level at 30. When the member 53 is raised, as illustrated is dotted outline at 53*a* the water level relative to the cleaner will be at 30*a*. The support structure 25, screen 26, wall 52 and chamber 53 can be pulled out through the aperture 54 in the rear of the cleaner. The wall 52 seals off the chamber when in position so that the water flows over the top.

What is claimed is:

1. A self-propelled pool surface cleaner for self generated floating movement on a surface of a pool, comprising:

a main body having a central chamber and including a float member extending on each side of said central chamber;

a front surface extending across said body forward of said central chamber, said front surface extending below said surface of a pool;

a barrier extending across said body, said barrier positioned at a rear edge of said front surface and at a front edge of said central chamber;

an impeller extending across said body above said front surface and adjacent to said barrier for propulsion of water from said surface of said pool rearward over said barrier into said central chamber to produce forward reaction action for movement of the cleaner on said surface of said pool;

a screen mounted in said central chamber and an exit from said central chamber, water flowing through said screen and from said central chamber;

drive means on said body for rotating said impeller, said drive means including an electric motor;

a self-contained power source in said body for supplying power to said electric motor and including a solar cell array on said body.

2. A cleaner as claimed in claim 1, said motor being mounted in one of said float members.

3. A cleaner as claimed in claim 1, including a rechargeable battery pack, said solar cell array adapted to charge said battery, said battery adapted to power said motor when said solar cell array produces insufficient power output.

4. A cleaner as claimed in claim 1, including a proximity sensor at a front surface of the body member, and a further impeller for ejecting water sideways or forward for turning the cleaner on approaching an obstruction.

5. A cleaner as claimed in claim 1, said screen being removable.

6. A cleaner as claimed in claim 1, including a back wall defining the back of said chamber, and an aperture in said back wall for the exit of the water after passing through said screen.

7. A cleaner as claimed in claim 1, including a support structure positioned in said chamber; said a screen positioned in said support structure, whereby the water pases through said screen.

8. A cleaner as claimed in claim 7, said support structure including a rear wall, said water exiting over said wall.

9. A cleaner as claimed in claim 7, said support structure being removable through the rear of said body.

10. A cleaner as claimed in claim 8, said rear wall of said support structure including an adjustable member for varying the height of the rear 11. A cleaner as claimed in claim 1, including a further impeller and means causing said further impeller to expel water from said body to turn the cleaner.

12. A cleaner as claimed in claim 11, including sensor means for sensing proximity of a pool wall and means actuated by said sensor means for activating said further impeller.

13. A cleaner as claimed in claim 1, said body comprising a bottom part and a top part, said top part extending over and attached to said bottom part.

* * * * *